US006997648B2

(12) United States Patent
Steffen

(10) Patent No.: US 6,997,648 B2
(45) Date of Patent: Feb. 14, 2006

(54) REMOTE CONTROL DEVICE FOR AUTOMOTIVE WORKING DEVICES

(75) Inventor: Michael Steffen, Munich (DE)

(73) Assignee: Wacker Construction Equipment AG, Munich (DE)

( * ) Notice: Subject to any disclaimer, the term of this patent is extended or adjusted under 35 U.S.C. 154(b) by 39 days.

(21) Appl. No.: 10/473,843

(22) PCT Filed: Mar. 22, 2002

(86) PCT No.: PCT/EP02/03260

§ 371 (c)(1),
(2), (4) Date: Sep. 30, 2003

(87) PCT Pub. No.: WO02/082397

PCT Pub. Date: Oct. 17, 2002

(65) Prior Publication Data

US 2004/0146303 A1 Jul. 29, 2004

(30) Foreign Application Priority Data

Apr. 3, 2001 (DE) ..... 101 16 526

(51) Int. Cl.
*E02D 3/02* (2006.01)

(52) U.S. Cl. ..... 405/271; 404/133.05

(58) Field of Classification Search ..... 405/271; 404/133.05, 133.1, 133.2
See application file for complete search history.

(56) References Cited

U.S. PATENT DOCUMENTS

| | | | | | |
|---|---|---|---|---|---|
| 4,621,375 | A | | 11/1986 | Simnovec | |
| 5,450,068 | A | * | 9/1995 | Steffen | 340/5.74 |
| 6,285,925 | B1 | * | 9/2001 | Steffen | 701/2 |
| 6,350,082 | B1 | * | 2/2002 | Rickards | 404/75 |
| 6,499,542 | B1 | * | 12/2002 | Greschner | 405/271 |
| 2004/0022582 | A1 | * | 2/2004 | Sick | 404/133.05 |

FOREIGN PATENT DOCUMENTS

| | | |
|---|---|---|
| DE | 41 39 041 A1 | 6/1992 |
| DE | 196 18 033 A1 | 11/1997 |
| EP | 0 869 221 A1 | 10/1998 |

* cited by examiner

*Primary Examiner*—Frederick L. Lagman
(74) *Attorney, Agent, or Firm*—Boyle Fredrickson Newholm Stein & Gratz S.C.

(57) ABSTRACT

In order to control automatic working devices, especially soil compacting devices, a remote control device is provided which comprises a transmitter unit which can be actuated by a user and which is used to transmit control signals in the form of electromagnetic radiation and a receiver unit which is arranged on the working device and which outputs the received control signals in the form of electric control commands to the control unit of a working device. During operation of the working device, the transmitter unit can be connected to an external power source, which is arranged on the working device, via a cable for the supply of power thereto.

19 Claims, 1 Drawing Sheet

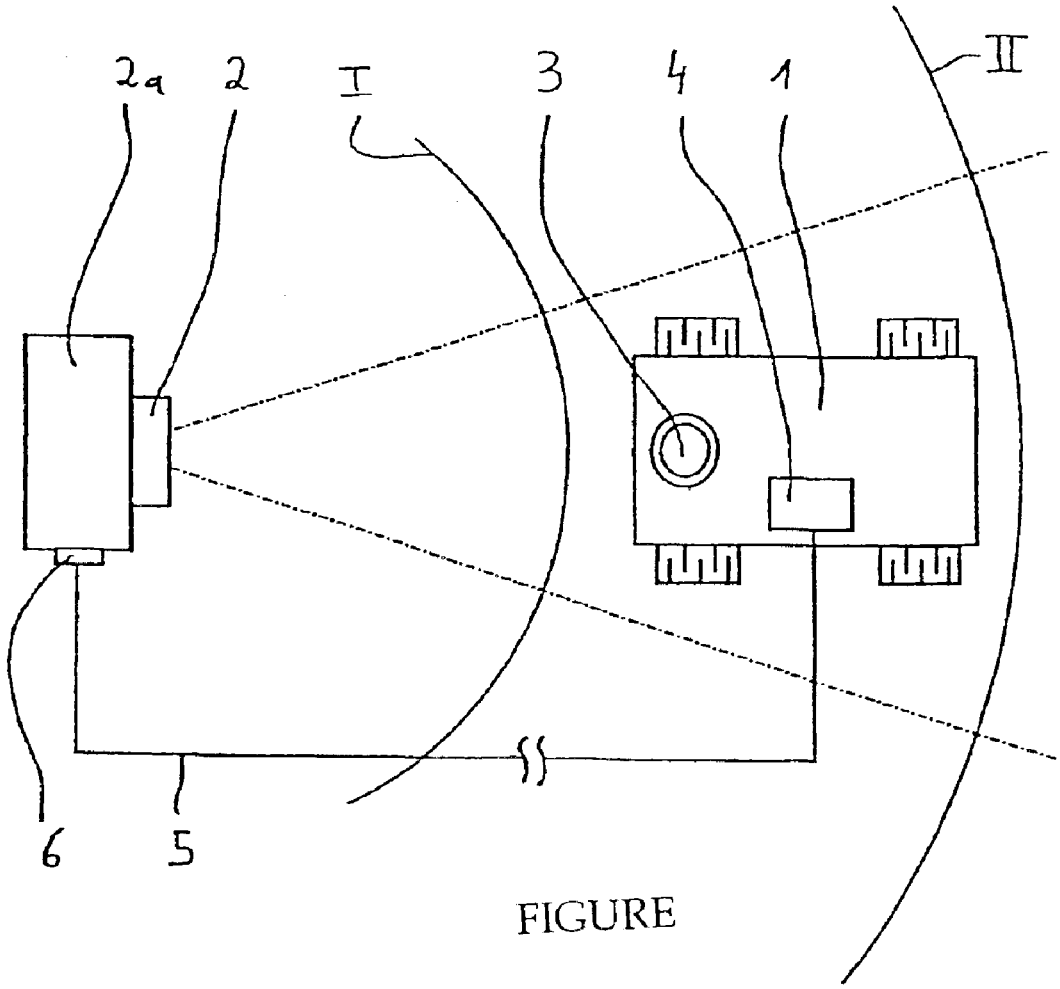
FIGURE

REMOTE CONTROL DEVICE FOR AUTOMOTIVE WORKING DEVICES

BACKGROUND OF THE INVENTION

1. Field of the Invention

The invention relates to a remote control device for automotive working devices; which can be used in particular in ground-compaction devices.

2. Description of the Related Art

One way of remotely controlling e.g. automotive working devices is to provide a cable connection between the working device and a transmitter of a remote control device, several wires being accommodated in said cable connection. On the one hand, the cable connection serves to transmit control commands from the transmitter of the remote control device to the working device. Furthermore, the transmitter is supplied with power from the working device by means of the cable connection. As a consequence, it is possible to maintain a continuous operation with the working device.

In the case of a working device which utilises this type of remote control, owing to the predetermined length of the cable the aforementioned cable connection means that the operator of the working device can only remain within a designated operating area. In other words, the length of the cable is dimensioned such that the operator is not able to walk in front of the moving working device. Furthermore, the operating area provided for the operator is rendered safe by means of safety devices, e.g. protective bars and pressure bars or the like which serve to stop the working device or to reverse the direction of travel of the working device, if the operator comes into contact with the safety device.

However, when operating this type of working device on a building site, it is not entirely impossible to cause damage to the safety devices provided on said device which means that it is no longer possible to guarantee the safety of the operator. For example, a protective bracket can become bent or can tear off from the working device, as a result of which it is no longer possible to stop the operation of the moving working device in a dangerous situation. A further disadvantage of remote control by means of the cable connection resides in the fact that the restricted length of the cable forces the operator to follow the working device constantly and to remain in close proximity thereto. As a result, the operator is continuously exposed to the noise, possible exhaust gases and/or vibrations of the working device.

To obviate the aforementioned disadvantages, a remote control device having an infrared system is known, wherein a modulated infrared light is transmitted from a transmitting unit to a receiving unit, which is disposed on the automotive working device, for the purpose of communicating the control commands. In accordance with current safety directives, the operator of this type of infrared remote control device is constantly in visual contact with the working device, wherein the transmitting unit is to be aligned with the receiving unit provided on the working device. As soon as the operator ceases to direct the infrared beam, which is output by the transmitting unit, to the receiving unit, e.g. as a result of a fall, the reception of the infrared signal and subsequently the operation of the working device are interrupted and the working device is shut off.

DE 42 21 793 C1 discloses an infrared remote control for automotive ground-compaction devices which uses a control device carried by the operator to transmit not only the infrared control radiation provided for the functional control of the working device but also short-range infrared radiation at a substantially lower intensity than the control radiation, so that this short-range radiation can only be received with sufficient intensity in the immediate surrounding area of the transmitter. Upon reception of this short-range radiation, the receiving unit on the working device serves to suppress the generation of electrical signals which are caused by the control radiation and which otherwise cause the working device to move.

In the case of this infrared remote control, the working device can be operated for as long as it is located within receiving range of the control radiation but outside the range of the short-range radiation. If the distance between the operator and the working device is less than a predetermined safety distance, i.e. if the short-range radiation is received by the receiving unit provided on the working device, the working device will be shut off.

One disadvantage of infrared systems is generally that the required beam power causes the transmitting unit to consume a substantial amount of power.

If during usage of the working device a battery provided for supplying power to the transmitting unit, or a transmitting storage cell has run out, this can lead to adverse interruptions in operation. Furthermore, there is a safety risk in the event that the discharge of the battery or the transmitter storage cell makes it no longer possible to control the working device perhaps at an inopportune moment.

DE 41 39 041 A1 describes a remote control device which can be operated both as a wireless system and as a system comprising a wire connection. A detector establishes whether a signal transmission cable is connected to the device, and outputs a corresponding signal to switching means which switch the device between the wireless system and the system comprising the wire connection. During the wire-connection operation, the control signals are transmitted via the cable which connects a transmitter to a receiver. In addition, the cable serves to supply power to the transmitter.

OBJECTS AND SUMMARY OF THE INVENTION

It is the object of the invention to provide a remote control device for automotive working devices which can be operated reliably and for lengthy operating periods without any compromise to safety during the transmission of control signals at high transmission power.

In accordance with the invention, the object is achieved by a remote control device for automotive working devices, in particular for ground-compaction devices having a transmitting unit, which can be operated by an operator, for transmitting control signals in the form of infrared radiation and having a receiving unit which is disposed on the working device and which outputs the received control signals as electrical control commands to a controller of the working device, characterized in that during operation of the working device, the transmitting unit can be connected via a cable to an external power source, which is disposed on the working device, for the supply of power.

It is possible for the external power source to be supplied also by the working device, e.g. by means of a dynamo of the ground-compaction device. Alternatively, the external power source can also be formed from a battery of the working device. In this manner, the supply of power to the transmitting unit of the remote control device is guaranteed irrespective of other power sources, e.g. when utilised on a building site.

In accordance with a further advantageous embodiment of the invention, the electromagnetic radiation comprises a short-range radiation portion, wherein the working device can be brought to a standstill, if the receiving unit receives this short-range radiation portion. In this way, it is possible to ensure that the operation of the working device is interrupted, if the distance between the operator and the working device is less than a predetermined safety distance.

One particularly advantageous embodiment of the remote control device is characterised in that the electromagnetic radiation further comprises control radiation which is modulated or encoded according to the control commands which are to be output to the controller of the working device, and that the receiving unit comprises means for distinguishing between the control radiation and the short-range radiation portion and comprises means for blocking the formation or output of the control commands, which are to be output to the controller, upon reception of the short-range radiation portion.

The solution in accordance with the invention has the advantage that it is possible to combine the advantages of infrared remote control with those of a cable remote control. In the case of one embodiment of the invention, the control signals are always transmitted by infrared from the transmitting unit to the receiving unit disposed on the working device, thus achieving at all times all of the aforementioned advantages afforded by infrared. The aforementioned near-field switch-off of the travel movements of the working device by means of the short-range radiation portion guarantees an adequate level of safety for the operator. Moreover, since the working device is controlled exclusively by the directed infrared radiation, the data flow will automatically be interrupted and the working device will be stopped if the operator falls, which thus eliminates the possible risk of the operator being run over, crushed etc. by the working device.

A further advantage of the remote control device in accordance with the invention is that the operator can control the working device from any location under the proviso that the safety distance between the operator and the working device is sufficient.

There is no restriction with respect to the length of the cable used between the transmitting unit and the external power source. The provision of an infrared remote control can also remove the need for any safety devices on the working device, such as e.g. in the form of a safety bracket, whereby it is possible to improve the fail-safe characteristics of the working device and in addition to achieve a reduction in costs.

In accordance with a further advantageous embodiment of the invention, the control radiation has a substantially greater intensity than the short-range radiation portion. Accordingly, the control radiation has a greater range than the short-range radiation portion, so that the working device can be operated outside the receiving range for the short-range radiation portion exclusively by the reception of the control radiation transmitted by the transmitting unit.

According to a further advantageous embodiment of the invention, the receiving unit is allocated a signal processing facility which is able to interrupt the operation of the working device, if the received control radiation does not correspond to a specified condition. This specified condition can be formed e.g. by a lower limit for the intensity of the control radiation. Particularly when used on a building site, a receiving unit surface can easily become soiled which leads to a general attenuation in the received electromagnetic radiation which is transmitted by the transmitting unit.

The safety of the operator which is to be guaranteed at all times is restricted by soiling of the receiving unit insofar as the short-range radiation portion which can have a lower intensity than the control radiation possibly can possibly no longer be received by the receiving unit and therefore it is no longer possible to shut off the working device. This disruption to the operation of the working device and the associated risk to the operator is compensated by virtue of the fact that upon reception of control radiation at a reduced intensity which results from the soiling of the receiving unit, the operation of the working device is accordingly interrupted by the signal processing facility. If this situation arises, the receiving unit is to be cleaned accordingly by the operator, after which the operation of the working device can be continued in the normal manner.

In accordance with a still further advantageous embodiment of the invention, the transmitting unit alternately transmits the control radiation and the short-range radiation portion. Alternatively, the transmitting unit can also transmit the control radiation and the short-range radiation portion simultaneously, wherein the short-range radiation portion is address-encoded in a different way compared to the control radiation.

A further advantageous embodiment of the invention is characterised in that the transmitting unit is electrically connected to a transmitting storage cell which can be recharged by the external power source. The transmitting storage cell is preferably attached to the transmitting unit. Should the operator's freedom of movement be restricted by the cable which connects the transmitting unit to the external power source, the cable can be readily removed from the transmitting unit for a certain amount of time, without thereby having to interrupt the controller of the working device owing to a lack of adequate power supplied to the transmitting unit.

BRIEF DESCRIPTION OF THE DRAWINGS

These and further advantages and features of the invention will be explained in detail hereinunder with the aid of exemplified embodiment of the invention with reference to the accompanying FIGURE.

The FIGURE shows a basic illustration of a remote control device in accordance with the invention for operating a working device.

DETAILED DESCRIPTION OF THE PREFERRED EMBODIMENTS

A remote control device for remotely controlling an automotive and remote-controllable working device 1, not explained in detail, such as e.g. a ground-compaction roller or a vibration plate, comprises a transmitting unit 2 and a receiving unit 3. The receiving unit 3 is disposed on the working device 1 and is connected to a controller (not shown) of the working device 1. The transmitting unit 2 is disposed on a hand-held device 2*a* which can be actuated by an operator, in order thereby to be able to input corresponding control commands for the working device. According to the input control commands, the transmitting unit 2 transmits modulated or encoded control radiation in the infrared wavelength range which is directed in such a manner as to be received by the receiving unit 3, e.g. an infrared eye, which is provided on the working device 1. The received control signals are output by the receiving unit 3 as electrical control commands to the controller of the working device 1, thus serving to control the working device 1 and to set it in motion accordingly.

Furthermore, the working device 1 is provided with an external power source 4 which is supplied by the working device 1. The external power source 4 can consist e.g. of a separate battery which is fed by a dynamo of the working device 1. Alternatively, the external power source 4 can also be formed from the battery of the working device 1. One end of the cable 5 (e.g. a bipolar cable) is attached to the external power source 4, wherein the cable 5 is guided in the direction of the transmitting unit 2. Another end of the cable 5 can be connected to the hand-held device 2*a* via a connection point 6, in order to supply power to the transmitting unit 2 from the external power source 4. Since in the case of the remote control device illustrated in this case the general safety directives for infrared remote controls are observed, the cable 5 can be designed to be any length, as it is provided exclusively for supplying power to the transmitting unit 2.

The infrared radiation transmitted by the transmitting unit 2 is composed of a short-range radiation portion with a range I and control radiation with a range II, wherein the control radiation has a correspondingly greater intensity than the short-range radiation portion. In order to control the working device in a problem-free manner, it is necessary for the operator always to align the infrared radiation, which is transmitted by the transmitting unit 2, in the direction of the receiving unit 3. As shown in principle by the dotted lines in the FIGURE which is not to scale, the infrared radiation is transmitted in the form of a directed beam in such a manner that the receiving unit 3 is located in the radiation range of the infrared beam and accordingly receives the infrared radiation.

In the event that the working device 1 is located in an area, in which exclusively the control radiation with the range II is received by the receiving unit 3, the received control signals are output as electrical control commands to the controller of the working device 1. If the operator moves in the direction of the working device 1, or if the working device 1 moves towards the operator during operation, the short-range radiation portion with the range I will also be received by the receiving unit 3 if the distance between the working device 1 and the operator becomes less than a predetermined safety distance. As a consequence, means which are not explained in detail and which are connected to the receiving unit 3 serve to prevent control commands from being output to the controller of the working device 1, thus causing the working device 1 to be shut off. Since the operation of the working device 1 is thus shut off in proximity to the operator, operator safety is guaranteed to a sufficient extent without having to provide other safety devices on the working device 1.

I claim:

1. A remote control device for a ground-compaction devices, comprising:

a transmitting unit, which can be operated by an operator, for transmitting control signals in the form of infrared radiation; and a receiving unit which is disposed on the ground compaction device and which outputs the received control signals as electrical control commands to a controller of the ground compaction device, wherein, during operation of the ground compaction device, the transmitting unit can be connected via a cable to an external power supply, which is disposed on the ground compaction device, for the supply of power, and wherein the control signals can also be transmitted in the form of infrared radiation, if the transmitting unit is connected via the cable to the power source.

2. A remote control device as claimed in claim 1, wherein the infrared radiation comprises a short-range radiation portion, wherein the ground compaction device can be brought to a standstill upon reception of this portion by the receiving unit.

3. A remote control device as claimed in claim 1, wherein the infrared radiation comprises control radiation which is modulated or encoded corresponding to the control commands which are to be output to the controller, and wherein the receiving unit comprises means for distinguishing between the control radiation and the short-range radiation portion and comprises means for blocking or outputting the control commands, which are to be output to the controller, upon reception of the short-range radiation portion.

4. A remote control device as claimed in claim 1, wherein the receiving unit is allocated a signal processing facility which is able to interrupt the operation of the ground compaction device, if the received control radiation does not correspond to a specified condition.

5. A remote control device as claimed in claim 3, wherein the control radiation comprises a substantially greater intensity than the short-range radiation portion.

6. A remote control device as claimed in claim 3, wherein the control radiation and the short-range radiation portion can be transmitted alternately by the transmitting unit.

7. A remote control device as claimed in claim 4, wherein the specified condition is a lower limit for the intensity of the control radiation.

8. A remote control device as claimed in claim 1, wherein the external power source is supplied by the working device.

9. A remote control device as claimed in claim 1, wherein the transmitting unit is electrically connected to a transmitting storage cell which can be recharged via the external power source.

10. A remote control device for a ground compaction device, comprising:

a transmitting unit disposed in a hand-held device and operable to transmit a control signal in an infrared wavelength range;

a receiving unit disposed on the ground compaction device, the receiving unit being configured to receive the control signal in the infrared wavelength range and to output the control signal as an electrical control command to a controller at the ground compaction device;

an external power source disposed on the ground compaction device; and a cable configured to connect the transmitting unit with the external power source for the supply of power to the transmitting unit, wherein the transmitter is configured to transmit the control signal in the infrared wavelength range when connected to the external power source via the cable.

11. A remote control device as claimed in claim 10, wherein the control signal comprises a short-range portion and a control portion, and wherein the ground compaction device is brought to a standstill upon reception of the short-range portion at the receiving unit.

12. A remote control device as claimed in claim 11, wherein an intensity of the control portion is greater than an intensity of the short-range portion.

13. A remote control device as claimed in claim 11, wherein the control portion is modulated or encoded to correspond with the electrical control command that is output to the controller, and wherein the receiving unit comprises:

means for distinguishing between the control portion and the short-range portion; and means for blocking the control command which is output to the controller upon reception of the short-range portion.

14. A remote control device as claimed in claim 11, wherein the control portion and the short-range portion can be transmitted alternately by the transmitting unit.

15. A remote control device as claimed in claim 11, wherein the receiving unit is operable to interrupt operation of the ground compaction device when the control portion does not correspond to a specified condition.

16. A remote control device as claimed in claim 15, wherein the specified condition is a lower limit for the intensity of the control portion.

17. A remote control device as claimed in claim 10, wherein the transmitting unit is electrically connected to a storage cell which can be recharged by connection to the external power source of the ground compaction device.

18. A remote control device as claimed in claim 10, wherein the receiving unit includes an infrared eye.

19. A remote control device as claimed in claim 10, wherein the external power source is a battery.

* * * * *

UNITED STATES PATENT AND TRADEMARK OFFICE

CERTIFICATE OF CORRECTION

PATENT NO. : 6,997,648 B2
APPLICATION NO. : 10/473843
DATED : February 14, 2006
INVENTOR(S) : Michael Steffen It is certified that error appears in the above-identified patent and that said Letters Patent is hereby corrected as shown below:

| | |
|---|---|
| CLAIM 1<br>Col. 5, Line 53 | Replace the word “devices” with --device--. |
| CLAIM 1<br>Col. 5, Line 63 | Replace the word “supply” with --source--. |
| CLAIM 8<br>Col. 6, Line 31 | Replace the word “working” with --ground compaction--. |
| CLAIM 10<br>Col. 6, Line 52 | Replace the word “transmitter” with --transmitting unit--. |

Signed and Sealed this

Fifth Day of February, 2008

JON W. DUDAS
*Director of the United States Patent and Trademark Office*